United States Patent [19]

Yoshida et al.

[11] Patent Number: 4,857,445

[45] Date of Patent: Aug. 15, 1989

[54] DIRECT POSITIVE PHOTO-SENSITIVE MATERIALS

[75] Inventors: Tetsuo Yoshida; Tatsuo Heki, both of Minami-ashigara, Japan

[73] Assignee: Fuji Photo Film Co., Ltd., Minami-ashigara, Japan

[21] Appl. No.: 16,551

[22] Filed: Feb. 19, 1987

[30] Foreign Application Priority Data

Feb. 20, 1986 [JP] Japan ..... 61-36420
Apr. 17, 1986 [JP] Japan ..... 61-88628

[51] Int. Cl.[4] ..... G03C 1/19; G03C 1/485

[52] U.S. Cl. ..... 430/509; 430/567; 430/589; 430/598

[58] Field of Search ..... 430/567, 598, 589, 940

[56] References Cited

U.S. PATENT DOCUMENTS

| | | | |
|---|---|---|---|
| 3,761,276 | 9/1973 | Evans | 430/567 |
| 4,471,044 | 9/1984 | Parton et al. | 430/598 |
| 4,478,928 | 10/1984 | Hess et al. | 430/598 |
| 4,571,380 | 2/1986 | Noguchi et al. | 430/589 |
| 4,582,779 | 4/1986 | Kubota et al. | 430/598 |

*Primary Examiner*—Richard L. Schilling
*Attorney, Agent, or Firm*—Burns, Doane, Swecker & Mathis

[57] ABSTRACT

A direct positive photo-sensitive material is described, wherein the material comprises at least one internal latent image-type silver halide emulsion layer containing core/shell-type silver halide grains consisting of substantially cubic or tetradecahedral grains mainly of the face (100) and being spectrally-sensitized with at least one sensitizing dye having the following formula:

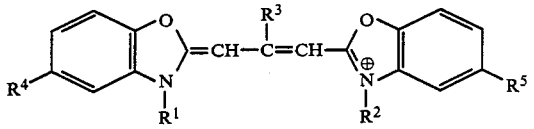

$(M^{\oplus 1})_m$ wherein $R^1$ and $R^2$ represent each a lower alkyl group substituted with a sulfonato, carboxyl or hydroxyl group, at least one of $R^1$ and $R^2$ being a sulfonatoalkyl group, $R^3$ represents a hydrogen atom or a lower alkyl or substituted or unsubstituted phenethyl group, $R^4$ represents a chlorine atom, a methoxy or ethoxy group or a hydrogen atom, $R^5$ represents a chlorine atom or a phenyl, alkoxy or alkyl group, $M^{+1}$ represents a cationic residue, m represents 0 or 1 with the proviso that when an inner salt is formed, m is 0.

17 Claims, No Drawings

DIRECT POSITIVE PHOTO-SENSITIVE MATERIALS

FIELD OF THE INVENTION

This invention relates to a previously unfogged internal latent image-type silver halide emulsion, and more particularly to a spectrally sensitized internal latent image-type silver halide emulsion which is useful for obtaining direct positive images by, for example, processing it with a surface developer in the presence of a fogging agent.

PRIOR ART

A process for obtaining direct positive images by processing an internal latent image-type silver halide photographic emulsion with a surface developer in the presence of a fogging agent, as well as photographic emulsions and photo-sensitive materials to be used in such a process are known from, for example, U.S. Pat. Nos. 2,456,953, 2,497,875, 2,497,876, 2,588,982, 2,675,318 and 3,227,552, British Pat. No. 1,151,363, Japanese Patent Publication No. 43-29405, U.S. Pat. No. 2,592,250, and British Pat. No. 1,011,062.

As direct positive silver halide emulsions, a previously surface-fogged emulsion (i.e. a previously fogged direct positive silver halide emulsion) is well-known in addition to the internal latent image-type emulsion which is developed in the presence of a fogging agent as described above. Also, it is known that an emulsion of this type can be spectrally-sensitized to a visible ray region with a sensitizing dye as described in, for example, U.S. Pat. No. 3,537,858.

However, the process for forming images using an internal latent image-type direct positive silver halide emulsion (i.e., a direct positive emulsion which is to be surface-developed in the presence of a fogging agent) of this invention is different from the process for forming images using a previously-fogged direct positive silver halide emulsion. A sensitizing dye effective for the previously-fogged direct positive silver halide emulsion is not always effective for the internal latent image-type positive silver halide emulsion of the present invention. In the latter type emulsion, direct positive images are obtained by conducting the surface development in the presence of a fogging agent. In this case, there is an interaction between a sensitizing dye and a fogging agent, and the sensitizing dye frequently exhibits an action of accelerating or suppressing the action of the fogging agent, in addition to its essential sensitizing action.

This fact is described in, for example, Research Disclosure, No. 15162 (1976), page 78, lines 6 to 17, wherein it is noted that in such a process, negatively charged dyes, dyes having counter ions, and uncharged dyes are more effective than positively charged cyanine dyes and, among them, merocyanine dyes having a carboxyl group as a substituent are particularly effective.

However, the photo-sensitive materials for obtaining such a spectrally-sensitized direct positive image have defects that $D_{max}$ and the sensitivity are reduced during the storage.

To solve the above-described problems, there have been proposed, various processes such as a process wherein a well-known stabilizer, e.g. 4-hydroxy-6-methyl-1, 3, 3*a*, 7-tetrazaindene or 1-phenyl-5-mercaptotetrazole is used, and a process wherein stabilizers mentioned in Japanese Patent Public Disclosure Nos. 57-86829 and 60-95533, techniques of which are known as those for improving the storage stability of direct positive photo-sensitive materials, are used. However, they are unsatisfactory since their effects are insufficient or $D_{min}$ is elevated.

A process wherein a merocyanine spectrally-sensitizing dye described in Japanese Patent Public Disclosure No. 60-10241 is used, has been known. However, such a sensitizing dye has defects, for example, that the dye makes the gradation of the reversed image soft and that when emulsions of core/shell-type grains having different grain sizes are used together for obtaining a wide exposure latitude, the effects thereof are reduced. Under these circumstances, a further improvement has been demanded.

SUMMARY OF THE INVENTION

One object of this invention is to provide a spectrally-sensitized direct positive photo-sensitive material having a good storage stability.

Another object of this invention is to provide a direct positive sensitive material having a wide exposure latitude and a good storage stability.

The objects of the present invention can be attained by forming, on a support, at least one internal latent image-type silver halide emulsion layer containing core/shell type silver halide grains substantially consisting of cubic or tetradecahedral grains mainly of the face (100), the grains being spectrally-sensitized with at least one sensitizing dye of the following general formula [I]:

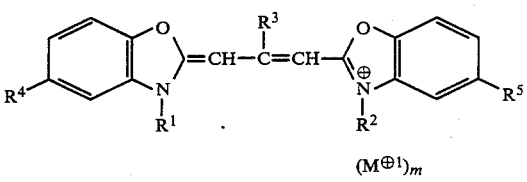

wherein $R^1$ and $R^2$ represent each a lower alkyl group (having preferably 4 or less carbon atoms) substituted with a sulfonato, carboxyl or hydroxyl group, at least one of $R^1$ and $R^2$ being a sulfonatoalkyl group; $R^3$ represents a hydrogen, lower alkyl group (having preferably 5 or less carbon atoms) or substituted or unsubstituted phenethyl group (the substituent being fluorine or chlorine atom, or methyl, ethyl, methoxy or hydroxyl group); $R^4$ represents a chlorine atom, methoxy or ethoxy group, or hydrogen atom; $R^5$ represents a chlorine atom, phenyl group, alkoxy group (having 4 or less carbon atoms) or alkyl group (having 4 or less carbon atoms); $M^{\oplus 1}$ represents a cationic residue (such as $Na^+$, $Ka^+$, $HN^+(C_2H_5)_3$, or $H^+$), and m represents 0 or 1 and, when an inner salt is formed, m is 0.

DETAILED DESCRIPTION OF THE INVENTION

The sensitizing dyes shown by the formula [I] are described below in detail.

Particularly preferred sensitizing dyes are those of the above general formula [I] wherein $R^1$ and $R^2$ each represent a sulfonatoalkyl group having 2 or 4 carbon atoms in which the alkylene moiety may be further substituted with a methyl group, chlorine atom, or hydroxyl group (such as 2-sulfonatoethyl, 3-sulfonatopropyl, 4-sulfonatobutyl, 3-methyl-3-sulfonatopropyl, 2-chloro-3-sulfonatopropyl or 2-hydroxy-3-sulfonatopropyl), $R^3$ represents a methyl, ethyl or propyl group, $R^4$ represents a methoxy or ethoxy group or chlorine atom, $R^5$ represents a chlorine atom or phenyl, methoxy or ethoxy group or more preferably, $R^4$ represents a methoxy group or chlorine atom, and $R^5$ represents a chlorine atom or methoxy or ethoxy group.

Specific examples of the compounds to be used in this invention are shown below, which by no means limit the scope of the dyes usable in this invention:

[I]-1

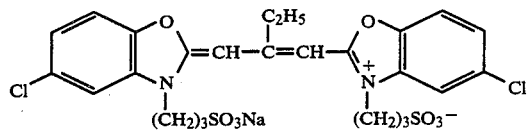

[I]-2

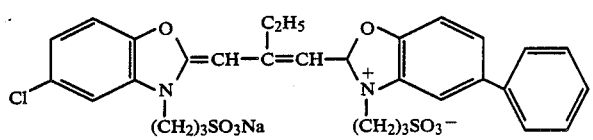

[I]-3

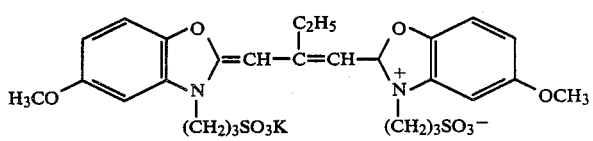

[I]-4

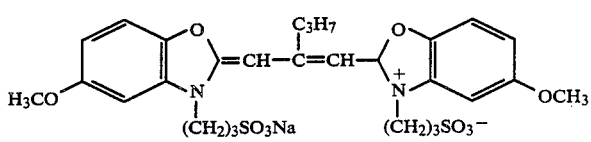

[I]-5

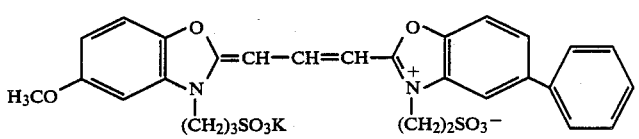

[I]-6

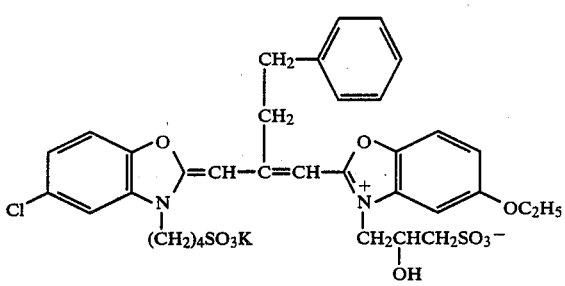

[I]-7

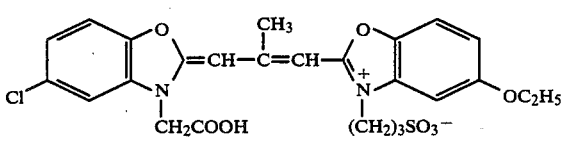

[I]-8

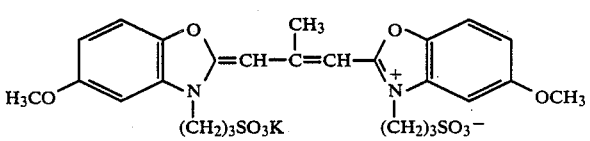

-continued

[I]-9

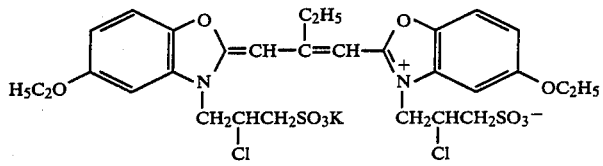

[I]-10

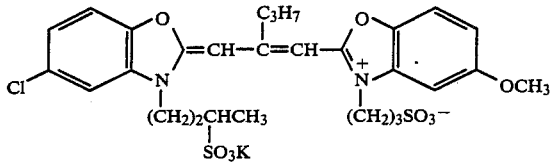

[I]-11

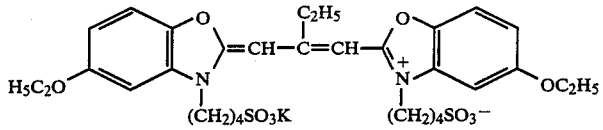

[I]-12

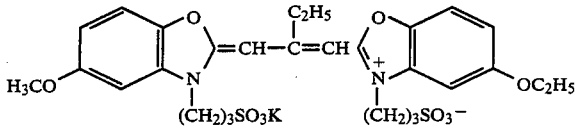

[I]-13

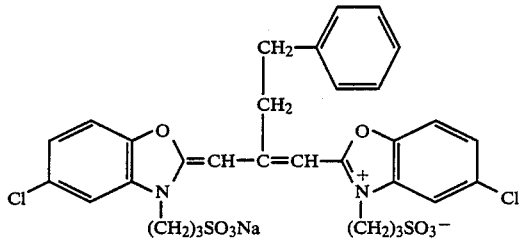

The present sensitizing dyes of the above general formula [I] are known compounds which can be synthesized according to the processes disclosed in Japanese Patent Public Disclosure No. 52-104,917 and Japanese Patent Publication Nos. 43-22,884, 48-25,652, and 57-22,368; F.M. Hamer, The Chemistry of Heterocyclic Compounds, Vol. 18, The Cyanine Dyes and Related Compounds, A. Weissberger ed Interscience, New York, 1964; D.M. Sturmer, The Chemistry of Heterocyclic Compounds, Vol. 30, A. Weissberger and E.C. Tayloe, eds., Hohn Willy, New York, 1977, p. 441; etc.

A compound of the general formula [I] can be incorporated in the silver halide emulsion of this invention by either directly dispersing it in the emulsion or dissolving it in a solvent such as water, methanol, ethanol, propanol, methyl cellosolve, 2,2,3,3-tetrafluoropropanol or a mixture of them and then adding the obtained solution to the emulsion. Further, an aqueous solution of the present compound which has been prepared in the presence of an acid or a base as described in Japanese Patent Publication Nos. 44-23,389, 44-27,555, 57-22,089, etc., or an aqueous solution or colloidal dispersion of the present compound as prepared in the presence of a surfactant disclosed in U.S. Pat. Nos. 3,822,135, 4,006,025, etc., can be added to the emulsion. The incorporation may be made by dissolving the present compound in a solvent which is substantially immiscible with water such as phenoxyethanol, dispersing the obtained solution in water or a hydrophilic colloid, and then adding the dispersion to said emulsion. Further, the incorporation may be made by directly dispersing the present compound in a hydrophilic colloid, and then adding the obtained dispersion to the emulsion as described in Japanese Patent Public Disclosure Nos. 53-102,733 and 58-105,141. The present compound is added to the emulsion usually before the emulsion is applied to a suitable support. However, the addition may be conducted during the chemical digestion or silver halide grain formation (for example, it may be added during the formation of the grains as described in Japanese Patent Public Disclosure No. 55-26589).

The sensitizing dye of the general formula [I] is used in an amount of about $2\times10^{-6}$ to $8\times10^{-3}$ mol per mol of the silver halide of the silver halide emulsion. When the silver halide grain size is 0.2 to 3.0 μm, further improved effects are obtained with about $5\times10^{-5}$ to $2\times10^{-3}$ mol of the present dye.

The core/shell-type silver halide grains of the present invention are preferably of a monodisperse system and the average grain diameter is preferably about 0.1 to 4 μm, particularly about 0.2 to 3 μm, so as to obtain effective results. The term "monodisperse grain" as used herein indicates that the silver halide grains of the emulsion have substantially a uniform diameter. Preferably, about 95% of the silver halide grains have a diameter within the average grain diameter ±40%, and more preferably within the average grain diameter ±30%.

The term "tetradecahedral grain of mainly the face (100)" indicates the grain wherein at least 60% of the total surface area of the grain is occupied by the face (100). The term "substantially consisting of cubic or tetradecahedral grain of mainly the face (100)" means that preferably at least 50%, more preferably at least 80% and particularly up to 95% of the core/shell-type grains contained in the emulsion are cubic or tetradecahedral grains of mainly the face (100).

The proportion of the face (100) occupying the silver halide grain surface can be determined easily by a method wherein a dye having a face selectivity (absorbability) is absorbed thereof and then the absorption spectrum is measured by a spectrophotometer.

This method is described in Journal of Imaging Science, 29, 165 (1985).

To widen the exposure latitude, a mixture of two or more emulsions containing the core/shell-type grains different in size can be used, or a multilayer (such as two or three layers) of the emulsions having the same color sensitivity can be formed.

Further, core/shell-type grain emulsions which are different in halogen compositions, crystal habits etc. may be employed as a combination thereof. In such a case, it is sufficient that one kind or more, or one layer or more of emulsions of the core/shell-type silver halide grains substantially consisting of cubic or tetradecahedral grains of mainly the face (100) may be contained. When the emulsions having different grain sizes is used in a mixture or in a form of a multilayer of them, it is preferable that the grains in the core/shell-type silver halide emulsion comprising cubic grains or those of mainly the face (100) have a grain size smaller than that of the grains in the other layer so as to obtain preferred results. The difference in the average grain size between them is preferably at least 20%. It is preferable usually in such a case that the average grain size of the emulsion layer at a light source side is larger than that at the other side. The grain size of the smaller core/shell-type silver halide grain in the emulsion is preferably 0.15 to 0.5 μm, more preferably 0.15 to 0.4 μm.

When the multiple layers are formed, emulsion layers having different color sensitivities (blue, red and green-sensitivities) may be formed.

The core/shell-type silver halide grains to be used for the preparation of the emulsion of this invention are prepared by forming silver halide cores which are doped with a metal ion and/or chemically sensitized, then coating the surfaces of the grains with a silver halide to form shells, and then chemically sensitizing the shells. It is unnecessary to coat the overall surface of the core with the shell. It is sufficient to coat at least a sensitive site (a site in which silver is formed by the photolysis caused by the exposure) of the core.

The chemical sensitization of the cores of the core/-shell-type silver halide grains is conducted by known processes such as that disclosed in Glafkides "Chimie et Physique Photographique" (published by Paul Montel Co. in 1967), V.L. Zelikman et al. "Making and Coating Photographic Emulsion" (published by The Focal Press Co. in 1964) or "Die Grundlagen der Photographischen Prozesse mit Silberhalogeniden" edited by H. Frieser (published by Akademische Verlagsgesellschaft in 1968).

More particularly, the chemical sensitization can be conducted by the sulfur sensitization process wherein a sulfur-containing compound reactive with silver and active gelatin are used, the reduction sensitization process wherein a reducing substance is used, and the noble metal sensitization process wherein gold or another noble metal compound is used. These processes may be employed singly or as a combination thereof. The most preferred results are obtained when a combination of the gold sensitization process with sulfur sensitization process is employed. Further, the reduction sensitization process may be combined with the reduction sensitization, if necessary. The sulfur sensitizers include thiosulfates, thioureas, thiazoles, rhodanines, etc. Examples of the sulfur sensitizers are mentioned in U.S. Pat. Nos. 1,574,944, 2,410,689, 2,278,947, 2,728,668 and 3,656,955. The reducing sensitizers include stannous salts, amines, hydrazine derivatives, formamidinesulfinic acid, silane compounds, etc. Examples of them are mentioned in U.S. Pat. Nos. 2,487,850, 2,419,974, 2,518,698, 2,983,609, 2,983,610 and 2,694,637. The noble metal sensitizers include, as well as gold complex salts, complex salts of metals in Group VIII in the Periodic Table such as platinum, iridium and palladium. Examples of them are mentioned in U.S. Pat. Nos. 2,399,083 and 2,448,060, and British Pat. No. 618,061.

The chemical sensitization can be conducted under suitable conditions. Usually, the conditions such that a pH is 9 or less, pAg is 10 or less, and temperature is 40° C. or above provide satisfactory results. If necessary, the conditions beyond these ranges can also be employed.

The core may be chemically sensitized and/or doped with a metal ion. The core can be doped with a metal ion in the presence of a metal ion source such as a cadmium salt, zinc salt, lead salt, thallium salt, iridium salt or its complex salt, rhodium salt or its complex salt, or iron salt or its complex salt in the processes such as the formation of the silver halide core or the physical aging. The metal ion is used usually in an amount of at least $10^{-6}$ mol per mol of the silver halide.

Processes for the treatment of the core silver halide and for coating the core silver halide grain surface with the shell-forming silver halide, have been well-known. For example, the processes disclosed in U.S. Pat. Nos. 3,206,316, 3,317,322, 3,367,778 (excluding the step of fogging the particle surface), and 3,761,276 can be employed advantageously.

The relative amounts of the core-forming silver halide and the shell-forming silver halide are not particularly limited, but usually the molar ratio of the former to the latter is ½ to 1/10.

Although it is preferable that the core-forming silver halide is the same as the shell-forming silver halide, they may be different from each other. Examples of the silver halides usable in this invention include silver bromide, iodide, chloride, chlorobromide, bromoiodide and chlorobromoiodide. A preferred silver halide emulsion comprises at least 50 mol % of silver bromide. The most preferred emulsion is a silver bromide or silver bromoiodide emulsion in particular containing silver bromide only or silver bromide containing about 10 mol % or less of silver iodide.

The core/shell-type silver halide grains used for layers other than the bottom layer may be in a regular crystal form such as cubic, octahedral or tetradecahedral; an irregular crystal form such as spherical or platy form; a complex crystal form thereof; or a mixture of various crystal forms.

The surfaces of the thus prepared core/shell-type silver halide grains are then chemically sensitized. The chemical sensitization method can be the same as that employed for the core. The chemical sensitization of the core/shell-type silver halide grain surface is conducted in such a manner that the properties of the internal latent image-type grains are not damaged. The term "property of the internal latent image-type grain" herein means that when the silver halide emulsion is applied to a transparent support, then exposed for a given time of 0.01 to 10 sec., and developed in the following developer. A (internal-type developer) at 20° C. for 3 min., the maximum density of the image determined by the ordinary photographic density measuring method is at least 5 times as high as that obtained by developing the silver halide emulsion which has been exposed in the same way as the above in the following developer B (surface developer) at 20° C. for 4 min.:

| | | |
|---|---|---|
| Developer A: | | |
| hydroquinone | | 15 g |
| monomethyl-p-aminophenol sesquisulfate | | 15 g |
| sodium sulfite | | 50 g |
| potassium bromide | | 10 g |
| sodium hydroxide | | 25 g |
| sodium thiosulfate | | 20 g |
| water | ad | 1 l |
| Developer B: | | |
| p-hydroxyphenylglycine | | 10 g |
| sodium carbonate | | 100 g |
| water | ad | 1 l |

The present core/shell-type silver halide grains are dispersed in the binder as well known in the art.

Gelatin is advantageously used as the binder and hydrophilic colloids other than gelatin can also be used.

The suitable hydrophilic colloids include, for example, proteins such as gelatin derivatives, graft polymers of gelatin and another polymer, albumin and casein; cellulose derivatives such as hydroxyethylcellulose, carboxymethylcellulose and cellulose sulfates; and sugar derivatives such as sodium alginate and starch derivatives.

The gelatins usable herein include those treated with lime or an acid, and gelatins treated with an enzyme as described in Bull. Soc. Sci. Photo., Japan, No. 16, p. 30 (1966) as well as hydrolyzates and enzymatic decomposition products thereof.

The internal latent image-type silver halide photographic emulsion usable in this invention may be used in combination with a methine dye or the like. The dyes usable for this purpose include cyanine, merocyanine, complex cyanine, complex merocyanine, holopolar cyanine, hemicyanine, styryl; and hemioxonol dyes. Particularly useful dyes are cyanine, merocyanine and complex merocyanine dyes. These dyes may have any nuclei which are used for ordinary cyanine dyes as basic heterocyclic nuclei. Examples of nuclei include pyrroline, oxazoline, thiazoline, pyrrole, oxazole, thiazole, selenazole, imidazole, tetrazole and pyridine nuclei; these nuclei fused with an alicyclic hydrocarbon ring or an aromatic hydrocarbon ring such as indolenine, benzindolenine, indole, benzoxazole, naphthoxazole, benzothiazole, naphthothiazole, benzoselenazole, benzimidazole and quinoline nuclei. These nuclei may have a substituent bonded to the carbon atom.

The merocyanine dyes or complex merocyanine dyes have a 5 or 6-membered heterocyclic nucleus such as pyrazoline-5-on thiohydantoin, 2-thiooxazolidine-2, 4-dion, thiazolidine-2, 4-dion, rhodanine or thiobarbituric acid nucleus, as a nucleus having a ketomethylene structure.

The useful sensitizing dyes are mentioned in, for example, German Pat. No. 929,080, U.S. Pat. Nos. 2,231,658, 2,493,748, 2,503,776, 2,519,001, 2,912,329, 3,655,394, 3,656,959, 3,672,987 and 3,694,217, British Pat. No. 1,242,588, and Japanese Patent Publication No. 44-14030.

When the present photo-sensitive material using the internal latent image-type silver halide photographic emulsion is prepared, the silver halide emulsion may be applied to a support together with, if necessary, other photographic layer. The amount of the emulsion to be applied is not limited, but a preferred reversal image is obtained when the emulsion is applied in an amount of about 40 to 800 mg (in terms of silver) per square ft. of the support.

The supports usable are those mentioned in Research Disclosure, Vol. 176 (1978), RD-17643, Paragraph [XVII].

To increase the sensitivity and contrast or to accelerate the development, the following additives may be added to the internal latent image-type silver halide photographic emulsion of this invention; polyalkylene oxides and their ethers, esters and amine derivatives; thioether compounds, thiomorpholines, quaternary ammonium salts, urethane derivatives, urea derivatives, imidazole derivatives, 3-pyrazolidones, etc. For example, those mentioned in U.S. Pat. Nos. 2,400,532, 2,423,549, 2,716,062, 3,617,280, 3,772,021 and 3,808,003, can be used.

The internal latent image-type silver halide photographic emulsion of this invention may contain an antifoggant and a stabilizer. These antifoggants and stabilizers are mentioned in Research Disclosure, Vol. 176 (1978), RD-17643, Paragraph [VI].

The internal latent image-type silver halide photographic emulsion of this invention may contain a developing agent. The developing agents include those mentioned in Research Disclosure, Vol. 176 (1978), RD-17643, Paragraph [XX].

The internal latent image-type silver halide photographic emulsion of this invention can be dispersed in a colloid which can be hardened with various organic or inorganic hardeners. The hardeners are those mentioned in Research Disclosure, Vol. 176 (1978), RD-17643, Paragraph [X].

The internal latent image-type silver halide photographic emulsion of this invention can contain a coating aid. The coating aids are those mentioned in Research Disclosure, Vol. 176 (1978), RD-17643, Paragraph [XI].

The internal latent image-type silver halide photographic emulsion of this invention may contain a color coupler. The color couplers are those mentioned in Research Disclosure, Vol. 176 (1978), RD-17643, Paragraph [VII].

The internal latent image-type silver halide photographic emulsion of this invention may contain further, an antistatic agent, plasticizer, matting agent, lubricant, U.V. absorber, flourescent brightening agent, aerial antifoggant, etc.

The photo-sensitive materials prepared from the internal latent image-type silver halide photographic emulsion of this invention may contain a dye effective as a filter dye or anti-irradiation dye or for various other purposes, in the photographic emulsion layer or another hydrophilic colloid layer. The dyes are those mentioned in Research Disclosure, Vol. 176 (1978), RD-17643, Paragraph [VII].

The internal latent image-type silver halide photographic emulsion of this invention is developed in the presence of a fogging agent (nucleating agent) or under overall light exposure, to form a reversed image. Typical examples of the fogging agents usable herein include hydrazines mentioned in U.S. Pat. Nos. 2,588,982 and 2,563,785; hydrazides and hydrazones mentioned in U.S. Pat. No. 3,227,552; acyl hydrazines mentioned in British Pat. No. 2,089,057; quaternary salts mentioned in British Pat. No. 1,283,835, Japanese Patent Publication No. 49-38164 and U.S. Pat. Nos. 3,615,615, 3,719,494, 3,734,738, 4,094,683 and 4,115,122; sensitizing dyes having a nucleating substituent having a fogging effect in the molecule as mentioned in U.S. Pat. No. 3,718,470; and acylhydrazinophenylthiourea compounds mentioned in U.S. Pat. Nos. 4,030,925 and 4,031,127. The fogging agents include further compounds mentioned in U.S. Pat. No. 4,139,387 and Japanese Patent Public Disclosure Nos. 54-1133126 and 54-74729.

The fogging agent is used desirably in such an amount that a sufficient maximum density will be obtained when the internal latent image-type silver halide emulsion of the present invention is developed with a surface developer. The fogging agent is preferably incorporated in the photographic emulsion layer or an adjacent layer.

The internal latent image-type silver halide photographic emulsions of this invention can be used for various applications. They are particularly advantageously used as silver halide emulsions for direct positive photosensitive materials, multilayer reversal color emulsions, or emulsions for multilayer structure color diffusion transfer process.

The photographic emulsion of this invention can be used in combination with a dye image-donor for the diffusion transfer which releases a diffusible dye as the development proceeds. With such a combination, an intended transferred image is formed in the image-receiving layer after a suitable developing process. As such dye image-donors for the diffusion transfer process, various compounds have been known, examples of which are mentioned in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, and 4,013,635, U.S. Patent Publication (USB) No. 351,673, British Pat. Nos. 840,731, 904,364 and 1,038,331, West German Patent Public Disclosure (OLS) Nos. 1,930,215, 2,214,381, 2,228,361, 2,317,134 and 2,402,900, French Pat. No. 2,284,140 and Japanese Patent Public Disclosure Nos. 51-113624 (corresponding to U.S. Pat. No. 4,055,428), and 51-104343, 53-149328, and 53-143323. Among them, dye donors which are non-diffusible but release diffusible dyes by cleavage after the oxidation-reduction reaction with an oxidation product of the developing agent are preferably used. Hereinafter, they will be referred to as DRR compounds.

The photo-sensitive material of the present invention can be developed by various known developers. Examples of the developers include polyhydroxybenzenes such as hydroquinone, 2-chlorohydroquinone, 2-methylhydroquinone, catechol and pyrogallol; aminophenols such as p-aminophenol, N-methyl-p-aminophenol and 2,4-diaminophenol; 3-pyrazolidones such as 1-phenyl-3-pyrazolidones, 1-phenyl-4,4-dimethyl-3-pyrazolidone, 1-phenyl-4-methyl-4-hydroxymethyl-3-pyrazolidone and 5,5-dimethyl-1-phenyl-3-pyrazolidone; and scorbic acids. They may be used singly or as a combination thereof.

Further, the developers mentioned in Japanese Patent Public Disclosure No. 58-55928 can also be used.

In the formation of a dye image in the presence of a dye-forming coupler, aromatic primary amine developers, preferably p-phenylenediamine developers, can be used. They include, for example, 4-amino-3-methyl-N,N-diethylaniline hydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline and 4-amino-N-ethyl-N-(β-hydroxyethyl)aniline. Such a developer can be incorporated in either an alkaline processing composition (processing element) or a suitable photo-sensitive element layer.

When the DRR compound is used in this invention, any silver halide developer capable of cross-oxidizing it can be used.

The developer may contain a preservation such as sodium sulfite, potassium sulfite, ascorbic acid or a reductone (e.g. piperidinohexose reductone).

A positive image can be formed directly by developing the photo-sensitive material of the present invention with a surface developer. The developing course by the surface developer is induced by the latent image or fogging nuclei existing on the silver halide grain surface. Although the developer is preferably free from any silver halide solubilizer, the solubilizer (such as a sulfite) may be contained therein unless the internal latent image makes substantially any contribution to the development until the development by the surface development center of the silver halide grain has been completed.

The developer may contain, as an alikali and a buffer, sodium hydroxide, potassium hydroxide, sodium carbonate, potassium carbonate, trisodium phosphate, sodium metaborate or the like. The amounts of these agents are determined so that the pH of the developer would be 10 to 13, preferably 11 to 12.5.

The developer may contain a color development accelerator such as benzyl alcohol. Advantageously, the developer contains a compound used usually as an antifoggant such as a benzimidazole compound, e.g. 5-nitrobenzimidazole or a benzotriazole compound, e.g. benzotriazole or 5-methylbenzotriazole, for the purpose of further lowering the minimum density of the direct positive image.

The photo-sensitive material of this invention can be processed with a viscous developer.

The viscous developer is a liquid composition containing processing components necessitated for the development of the silver halide emulsion and forming the diffusion transfer dye image. The solvent comprises mainly water and, if necessary, a hydrophilic solvent such as methanol or methylcellosolve. This composition contains an alikali required for keeping a pH necessary for inducing the development in the emulsion layer and for neutralizing an acid (such as hydrohalogenic acids, e.g. hydrobromic acid, and carboxylic acid, e.g. acetic acid) which is formed in the development step and dye image-forming step. The alkalis include alkali metal and alkaline earth metal salts and amines, such as lithium hydroxide, sodium hydroxide, potassium hydroxide, calcium hydroxide dispersion, tetramethylammonium hydroxide, sodium carbonate, trisodium phosphate and diethylamine. Preferred alkalis are caustic alkalis having a concentration so that the pH is at least about 12, particularly at least 14, at room temperature.

When the photo-sensitive material of this invention is used in the diffusion transfer photographic method, this photo-sensitive material is preferably in the form of a film unit. The photographic film unit which is to be processed by passing it between a pair of juxtaposed pressing elements comprises essentially the following three elements:

(1) the present sensitive element containing a fogging agent, (2) an image-receiving element, and (3) a processing element having a means of releasing the alkaline processing composition in the film unit, and containing the silver halide developer, such as a breakable container.

EXAMPLE 1

Emulsions A

An aqueous solution of potassium bromide and an aqueous solution of silver nitrate were added simultaneously to an aqueous gelatin solution under vigorous stirring at 75° C. in about 40 min. to produce a silver bromide emulsion in which the grains had an average diameter of 0.04 μm. Each 4 mg, per mol of silver, of sodium thiosulfate and chloroauric acid (tetrahydrate) were added to the emulsion and the mixture was heated at 75° C. for 80 min., to conduct the chemical sensitization. The silver bromide grains thus obtained were used as the cores and these grains were grown under the same conditions as in the first precipitation step except that the pAg of the solution was controlled at 7.95, to finally produce a monodisperse emulsion of core/shell-type silver bromide grains having an average diameter of 0.6 μm. After washing with water followed by desalting, 0.9 mg, per mol of silver, of sodium thiosulfate was added to the emulsion and the mixture was heated at 65° C. for 60 min. to conduct the chemical sensitization. Thus, the internal latent image-type silver halide emulsion A-1 was obtained.

Emulsions A-2 and A-3 were prepared in the same manner as above except that the pAg of the solution used in the second precipitation step was changed to 8.20 or 8.85, respectively. The proportions of the face (100) occupying the whole grain surfaces of the respective emulsions were determined by a method described in Journal of Imaging Science, 29, 165 (1985). The other face was the face (111).

TABLE 1

| Emulsion | Proportion of the face (100) (%) |
|---|---|
| A-1 | 93 |
| A-2 | 80 |
| A-3 | 12 |

$4\times10^{-3}$ mol, per mol of silver, of spectrally-sensitizing dyes [I]-1, [I]-2, and [I]-3 and, comparative spectrally-sensitizing dyes [a] to [e] shown below were added to Emulsions A-1 to A-3. 257 mg, per mol of silver, of anhydro-2-[3-(phenyl-hydrazolo)butyl]-3-(3-sulfopropyl)benzothiazol hydroxide was added as a fogging agent to each of the emulsions. The emulsions were applied to PET supports in such an amount that 3.0 g/m$^2$ of Ag would be deposited thereon. Then, a gelatin protective layer was formed thereon to form Sample Nos. 1 to 24.

Comparative Spectrally-Sensitizing Dyes (a)

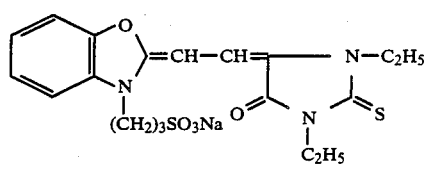

(b)

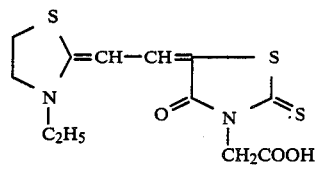

(c)

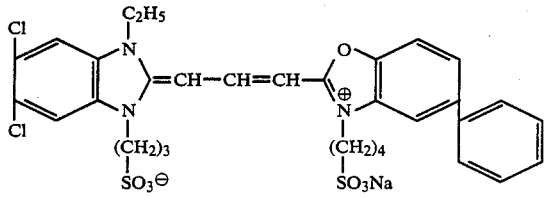

(d)

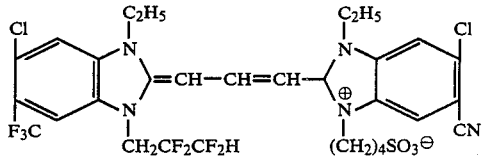

(e)

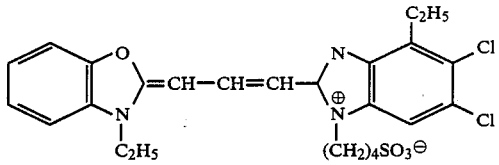

These samples were subjected to accelerated aging tests in which they were left to stand at 40° C. in 80% RH for 3 days (hereinafter referred to as Test A), or at 50° C. in 10% RH for 3 days (hereinafter referred to as Test B).

These samples were exposed to 1 kW tungsten light through a step wedge at a dye temperature of 2854° K. for 1 sec. Each of the samples was stirred in the following Developer C at 36° C. for 1 min. After the stopping followed by fixing and washing with water, a positive image was obtained.

| Developer C | | |
|---|---|---|
| hydroquinone | | 45 g |
| sodium sulfite | | 100 g |
| sodium carbonate | | 20 g |
| sodium bromide | | 3 g |
| 1-phenyl-4-methyl-4-hydroxymethyl-3-pyrazolidone | | 3 g |
| 5-methylbenzotriazole | | 40 mg |
| water | ad | 1 l |

The pH of the developer was controlled at 11.8 with potassium hydroxide.

In a major part of the dyes and emulsions, $D_{max}$ of them were reduced in Test A and the sensitivity at an optical density of 0.5 was reduced in Test B.

Table 2 shows the $D_{max}$ ratio of the sample after Test A to the fresh sample, i.e. $D_{max}$ (Test A)/$D_{max}$ (Fresh), and the relative value $\Delta S_{0.5}$ (Test B) of the sensitivity (at a concentration of 0.5) of the sample after Test B to that of Fresh sample.

The term "Fresh sample" means a sample immediately after the preparation (i.e. the sample has not been subjected to the accelerated aging test).

TABLE 2

| No. | | Emulsion | Spectrally-sensitizing dye | $D_{max}$ (Test A) / $D_{max}$ (Fresh) | $\Delta S_{0.5}$ (Test B) |
|---|---|---|---|---|---|
| 1 | Present invention | A-1 | [I]-1 | 1.02 | +0.01 |
| 2 | " | -2 | " | 0.98 | −0.02 |
| 3 | Comparative | -3 | " | 0.73 | +0.04 |
| 4 | Present invention | -1 | [I]-2 | 1.00 | ±0.00 |
| 5 | " | -2 | " | 1.00 | +0.03 |
| 6 | Comparative | -3 | " | 0.70 | ±0.03 |
| 7 | Present invention | -1 | [I]-3 | 0.99 | −0.03 |
| 8 | " | -2 | " | 1.00 | −0.04 |
| 9 | Comparative | -3 | " | 0.68 | +0.05 |
| 10 | " | -1 | [a] | 1.00 | −0.25 |
| 11 | " | -2 | " | 0.99 | −0.20 |
| 12 | " | -3 | " | 0.98 | −0.18 |
| 13 | " | -1 | [b] | 0.98 | −0.38 |
| 14 | " | -2 | " | 0.95 | −0.35 |
| 15 | " | -3 | " | 0.98 | −0.28 |
| 16 | " | -1 | [c] | 0.88 | −0.15 |
| 17 | " | -2 | " | 0.89 | −0.12 |
| 18 | " | -3 | " | 0.80 | −0.10 |
| 19 | " | -1 | [d] | 0.95 | −0.22 |
| 20 | " | -2 | " | 0.90 | −0.20 |
| 21 | " | -3 | " | 0.90 | −0.15 |
| 22 | " | -1 | [e] | 0.98 | −0.35 |
| 23 | " | -2 | " | 1.00 | −0.35 |
| 24 | " | -3 | " | 0.92 | −0.30 |

*$\Delta S_{0.5}$ is expressed by Log E (exposure); the negatiave numbers mean the desensitization.

It is apparent from Table 2 that Sample Nos. 1, 2, 4, 5, 7 and 8 (the present invention) had their original properties which were the same as those of the fresh samples after Tests A and B, and that the effects of the present invention are remarkable.

With respect to most comparative spectrally-sensitizing dyes, the results of the sample having a low face (100) ratio (Emulsion A-3) exhibited better results. Thus, the results obtained according to the present invention were unexpectable.

EXAMPLE 2

Emulsions B

An aqueous potassium bromide solution and an aqueous silver nitrate solution were added simultaneously to an aqueous gelatin solution under vigorous stirring at 40° C. during about 20 min. to produce an emulsion of silver bromide grains having an average diameter of 0.08 μm. Each 580 mg, per mol of silver, of sodium thiosulfate and chloroauric acid (tetrahydrate) were added to the emulsion and the mixture was heated at 75° C. for 80 min. to conduct the chemical sensitization. The silver bromide grains thus obtained were used as the cores and these grains were grown further under the same conditions as in the first precipitation step except that the pAg of the solution was controlled at 7.90, so as to finally obtain a monodisperse emulsion of core/shell-type silver bromide grains having an average diameter of 0.18 μm. After washing with water followed by desalting, each 6.2 mg, per mol of silver, of sodium thiosulfate and chloroauric acid (tetrahydrate) were added to the emulsion and then chemically sensitized by heating at 65° C. for 60 min., so as to obtain Emulsion B-1.

Emulsions B-2 and B-3 were prepared in the same manner as above except that the pAg of the solution used in the second precipitation step was changed to 8.13 or 8.74, respectively. The proportions of the face (100) occupying the whole grain surfaces of the respective emulsions were determined by a method described in Journal of Imaging Science, 29, 165 (1985). The other face was the face (111).

TABLE 3

| Emulsion | Proportion of the face (100) (%) |
|---|---|
| B-1 | 98 |
| B-2 | 85 |
| B-3 | 15 |

The same procedure as in Example 1 was repeated except that $5\times10^{-3}$ mol, per mol of silver, of the same spectrally-sensitizing dye as in Example 1 was used and the amount of coated silver was changed to 2 g/m$^2$. The results are shown in Table 4.

TABLE 4

| No. | | Emulsion | Spectrally-sensitizing dye | $D_{max}$ (Test A) / $D_{max}$ (Fresh) | $\Delta S_{0.5}$ (Test B) |
|---|---|---|---|---|---|
| 25 | Present | B-1 | [I]-1 | 0.99 | +0.02 |

TABLE 4-continued

| No. | | Emulsion | Spectrally-sensitizing dye | $D_{max}$ (Test A) $D_{max}$ (Fresh) | $\Delta S_{0.5}$ (Test B) |
|---|---|---|---|---|---|
| | invention | | | | |
| 26 | " | -2 | " | 0.99 | ±0 |
| 27 | Comparative | -3 | " | 0.65 | +0.10 |
| 28 | Present invention | -1 | [I]-2 | 1.00 | −0.01 |
| 29 | " | -2 | " | 1.01 | +0.02 |
| 30 | Comparative | -3 | " | 0.62 | +0.13 |
| 31 | Present invention | -1 | [I]-3 | 0.97 | −0.04 |
| 32 | " | -2 | " | 0.96 | −0.03 |
| 33 | Comparative | -3 | " | 0.70 | +0.07 |
| 34 | " | -1 | [a] | 0.98 | −0.23 |
| 35 | " | -2 | " | 0.96 | −0.20 |
| 36 | " | -3 | " | 0.88 | −0.15 |
| 37 | " | -1 | [b] | 0.95 | −0.30 |
| 38 | " | -2 | " | 0.99 | −0.22 |
| 39 | " | -3 | " | 0.89 | −0.25 |
| 40 | " | -1 | [c] | 0.99 | −0.15 |
| 41 | " | -2 | " | 1.00 | −0.14 |
| 42 | " | -3 | " | 0.80 | −0.13 |
| 43 | " | -1 | [d] | 0.95 | −0.20 |
| 44 | " | -2 | " | 0.89 | −0.21 |
| 45 | " | -3 | " | 0.88 | −0.17 |
| 46 | " | -1 | [e] | 0.95 | −0.30 |
| 47 | " | -2 | " | 0.93 | −0.30 |
| 48 | " | -3 | " | 0.89 | −0.30 |

It is apparent from Table 4 that the effects of this invention are remarkable even when the average grain size is relatively small.

EXAMPLE 3

A multilayer comprising an upper layer of Emulsion A and lower layer of Emulsion B in amounts of 1.5 g/m$^2$ amd 1.0 g/m$^2$ (in terms of silver), respectively, was formed and then a protective gelatin layer was formed thereon, so as to obtain a sample. In this step, the same spectrally-sensitizing dye was contained in both layers in the same amounts as in Examples 1 and 2. The accelerated aging tests were carried out for the various combinations of the emulsions and the sensitizing dyes in the same manner as in Example 1. The results are shown in Table 5.

TABLE 5

| No. | | Emulsion Upper layer | Emulsion Lower layer | Spectrally-Sensitizing dye | $D_{max}$ (Test A) $D_{max}$ (Fresh) | $\Delta S_{0.5}$ (Test B) |
|---|---|---|---|---|---|---|
| 49 | Present invention | A-1 | B-1 | [I]-1 | 0.98 | −0.03 |
| 50 | " | " | B-3 | " | 0.90 | +0.04 |
| 51 | " | A-3 | B-1 | " | 0.98 | −0.02 |
| 52 | Comparative | " | B-3 | " | 0.65 | +0.18 |
| 53 | Present invention | A-1 | B-1 | [I]-2 | 0.99 | −0.02 |
| 54 | " | " | B-3 | " | 0.91 | +0.05 |
| 55 | " | A-3 | B-1 | " | 1.01 | −0.01 |
| 56 | Comparative | " | B-3 | " | 0.64 | +0.22 |
| 57 | " | A-1 | B-1 | [a] | 0.98 | −0.22 |
| 58 | " | " | B-3 | " | 0.95 | −0.18 |
| 59 | " | A-3 | B-1 | " | 0.92 | −0.15 |
| 60 | " | " | B-3 | " | 0.93 | −0.20 |
| 61 | " | A-1 | B-1 | [d] | 0.95 | −0.16 |
| 62 | " | " | B-3 | " | 0.96 | −0.14 |
| 63 | " | A-3 | B-1 | " | 0.97 | −0.12 |
| 64 | " | " | B-3 | " | 0.93 | −0.21 |

It is understood that the effects of this invention are remarkable when the multilayer comprising layers of the emulsions having different average grain sizes was formed. It is also understood that the emulsion having a high face (100) ratio is effective particularly when the grain size thereof is small.

EXAMPLE 4

Sample Nos. 65 to 88 were prepared in the same manner as in Example 2 except that 400 mg, per mol of silver, of the compound having the following structural formula [1] was used as a fogging agent. The accelerated aging tests were carried out in the same manner as in Example 1. The results are shown in Table 6.

Formula [1]

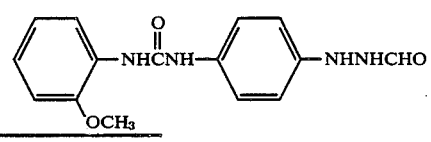

TABLE 6

| No. | | Emulsion | Spectrally-sensitizing dye | $D_{max}$ (Test A) / $D_{max}$ (Fresh) | $\Delta S_{0.5}$ (Test B) |
|---|---|---|---|---|---|
| 65 | Present invention | B-1 | [I]-1 | 0.99 | ±0.02 |
| 66 | " | -2 | " | 1.01 | −0.01 |
| 67 | Comparative | -3 | " | 0.78 | +0.04 |
| 68 | Present invention | -1 | [I]-2 | 1.01 | −0.01 |
| 69 | " | -2 | " | 1.02 | −0.01 |
| 70 | Comparative | -3 | " | 0.75 | +0.06 |
| 71 | Present invention | -1 | [I]-3 | 0.98 | −0.02 |
| 72 | " | -2 | " | 1.00 | −0.03 |
| 73 | Comparative | -3 | " | 0.70 | +0.04 |
| 74 | " | -1 | [a] | 0.99 | −0.23 |
| 75 | " | -2 | " | 0.98 | −0.20 |
| 76 | " | -3 | " | 0.97 | −0.18 |
| 77 | " | -1 | [b] | 1.03 | −0.34 |
| 78 | " | -2 | " | 1.01 | −0.33 |
| 79 | " | -3 | " | 0.99 | −0.29 |
| 80 | " | -1 | [c] | 0.85 | −0.18 |
| 81 | " | -2 | " | 0.84 | −0.14 |
| 82 | " | -3 | " | 0.78 | −0.16 |
| 83 | " | -1 | [d] | 0.96 | −0.30 |
| 84 | " | -2 | " | 0.92 | −0.28 |
| 85 | " | -3 | " | 0.92 | −0.17 |
| 86 | " | -1 | [e] | 0.99 | −0.35 |
| 87 | " | -2 | " | 1.01 | −0.35 |
| 88 | " | -3 | " | 0.94 | −0.30 |

It is understood from Table 6 that the effects of this invention are remarkable when the fogging agent [1] is used.

EXAMPLE 5

Sample Nos. 89 to 112 were prepared in the same manner as in Example 2 except that 70 mg, per mol of silver, of a compound of the following structural formula [2] was used as a fogging agent. The accelerated aging tests were carried out in the same manner as in Example 1. The results are shown in Table 7.

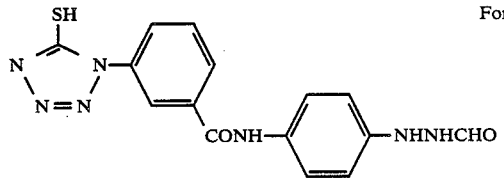

Formula [2]

TABLE 7

| No. | | Emulsion | Spectrally-sensitizing dye | $D_{max}$ (Test A) / $D_{max}$ (Fresh) | $\Delta S_{0.5}$ (Test B) |
|---|---|---|---|---|---|
| 89 | Present invention | B-1 | [I]-1 | 1.03 | −0.02 |
| 90 | " | -2 | " | 1.04 | −0.02 |
| 91 | Comparative | -3 | " | 0.88 | +0.03 |
| 92 | Present invention | -1 | [I]-2 | 1.04 | −0.02 |
| 93 | " | -2 | " | 1.03 | −0.02 |
| 94 | Comparative | -3 | " | 0.84 | +0.05 |
| 95 | Present invention | −1 | [I]-3 | 1.00 | −0.01 |
| 96 | " | −2 | " | 1.03 | −0.03 |
| 97 | Comparative | −3 | " | 0.78 | +0.04 |
| 98 | " | −1 | [a] | 1.02 | −0.33 |
| 99 | " | −2 | " | 1.01 | −0.26 |
| 100 | " | −3 | " | 1.05 | −0.30 |
| 101 | " | −1 | [b] | 1.02 | −0.30 |
| 102 | " | −2 | " | 1.01 | −0.30 |
| 103 | " | −3 | " | 1.03 | −0.30 |
| 104 | " | −1 | [c] | 0.89 | −0.24 |
| 105 | " | −2 | " | 0.85 | −0.20 |
| 106 | " | −3 | " | 0.82 | −0.18 |
| 107 | " | −1 | [d] | 1.02 | −0.28 |
| 108 | " | −2 | " | 0.94 | −0.25 |
| 109 | " | −3 | " | 0.93 | −0.22 |
| 110 | " | −1 | [e] | 1.01 | −0.36 |
| 111 | " | −2 | " | 1.03 | −0.36 |
| 112 | " | −3 | " | 0.96 | −0.32 |

It is understood from Table 7 that the effects of this invention are remarkable when the fogging agent [2] is used.

What is claimed is:

1. A direct positive photo-sensitive material comprising, on a support, at least one internal latent image-type silver halide emulsion layer containing core/shell-type silver halide grains consisting of substantially cubic or tetradecahedral grains of mainly the face (100) and being spectrally-sensitized with at least one sensitizing dye of the following general formula (I):

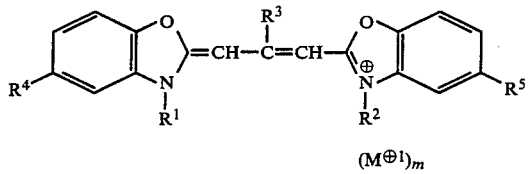

$(M^{\oplus 1})_m$ wherein $R^1$ and $R^2$ each represent a lower alkyl group substituted with a sulfonato, carboxyl or hydroxyl group, at least one of $R^1$ and $R^2$ being a sulfonatoalkyl group, $R^3$ represents a hydrogen atom or a lower alkyl or substituted or unsubstituted phenethyl group, $R^4$ represents a chlorine atom, a methoxy or ethoxy group or a hydrogen atom, $R^5$ represents a chlorine atom or a phenyl, alkoxy or alkyl group, $M^{+1}$ represents a cationic residue, m represents 0 or 1 with the proviso that when an inner salt is formed, m is 0.

2. The material of claim 1, wherein $R_1$ and $R_2$ are sulfonatoalkyl groups of $C_2 \sim C_4$.

3. The material of claim 1, wherein the $R_3$ is a methyl, ethyl or propyl group.

4. The material of claim 1, wherein the $R_4$ is a methoxy or ethoxy group, or a chlorine atom.

5. The material of claim 1, wherein the $R_5$ is a methoxy, ethoxy or phenyl group, or a chlorine atom.

6. The material of claim 1, wherein said core/shell-type silver halide grains are monodispersed.

7. The material of claim 1, wherein said core/shell-type silver halide grains have an average grain diameter of about 0.1 to 4 μm.

8. The material of claim 7, wherein said core/shell-type silver halide grains have an average grain diameter of about 0.2 to 3 μm.

9. The material of claim 1, wherein up to 95% of the core/shell-type silver halide grains have a grain diameter within the average grain diameter ±40%.

10. The material of claim 9, wherein up to 95% of the core/shell-type silver halide grains have a grain diameter within the average grain diameter ±30%.

11. The material of claim 1, wherein said core/shell-type silver halide grains comprising two or more kinds of core/shell-type silver halide grains which are different from each other in their grain diameters.

12. The material of claim 11, wherein said core/shell-type silver halide grains comprise two kinds or more of core/shell-type silver halide grains which are different from each other in their grain diameter.

13. The material of claim 12, wherein at least one kind of grains other than the largest size grains are core/-shell-type silver halide grains substantially consisting of cubic or tetradecahedral grains of mainly the face (100).

14. The material of claim 13, wherein the smallest size grains are core/shell-type silver halide grains substantially consisting of cubic or tetradecahedral grains of mainly the face (100).

15. The material of claim 12, wherein the smaller grains are contained in a layer adjacent to said support and the larger grains are contained in a layer remote from said support.

16. The material of claim 15, wherein the smaller grains have a grain diameter of 0.15 to 0.5 μm.

17. The material of claim 16, wherein the smaller grains have a grain diameter of 0.15 to 0.4 μm.

* * * * *